US010013966B2

(12) United States Patent
Kwatra et al.

(10) Patent No.: US 10,013,966 B2
(45) Date of Patent: Jul. 3, 2018

(54) SYSTEMS AND METHODS FOR ADAPTIVE ACTIVE NOISE CANCELLATION FOR MULTIPLE-DRIVER PERSONAL AUDIO DEVICE

(71) Applicant: Cirrus Logic International Semiconductor Ltd., Edinburgh (GB)

(72) Inventors: Nitin Kwatra, Austin, TX (US); Jon D. Hendrix, Wimberley, TX (US); John L. Melanson, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 34 days.

(21) Appl. No.: 15/070,457

(22) Filed: Mar. 15, 2016

(65) Prior Publication Data

US 2017/0270906 A1 Sep. 21, 2017

(51) Int. Cl.
*G10K 11/178* (2006.01)
*H04R 3/12* (2006.01)

(52) U.S. Cl.
CPC ..... *G10K 11/1786* (2013.01); *G10K 11/178* (2013.01); *G10K 11/17879* (2018.01);
(Continued)

(58) Field of Classification Search
CPC .. H04R 1/1083; H04R 2410/05; H04R 5/033; G10K 11/178; G10K 2210/3026;
(Continued)

(56) References Cited

U.S. PATENT DOCUMENTS 4,649,507 A 3/1987 Inaba et al.
5,117,401 A 5/1992 Feintuch
5,204,827 A 4/1993 Fujita et al.
5,251,263 A 10/1993 Andrea et al.
5,278,913 A 1/1994 Delfosse et al.
5,321,759 A 6/1994 Yuan
5,337,365 A 8/1994 Hamabe et al.
5,359,662 A 10/1994 Yuan et al.
5,377,276 A 12/1994 Terai et al.
5,410,605 A 4/1995 Sawada et al.
5,425,105 A 6/1995 Lo et al.
(Continued)

FOREIGN PATENT DOCUMENTS

CN 101552939 A 10/2009
DE 102011013343 A1 9/2012
(Continued)

OTHER PUBLICATIONS

International Patent Application No. PCT/US2014/061548, International Search Report and Written Opinion, dated Feb. 12, 2015, 13 pages.
(Continued)

*Primary Examiner* — George C Monikang
(74) *Attorney, Agent, or Firm* — Jackson Walker L.L.P.

(57) ABSTRACT

In accordance with embodiments of the present disclosure, a processing circuit may implement an adaptive filter, a first signal injection portion which injects a first additional signal into a first frequency range content source audio signal, and a second signal injection portion which injects a second additional signal into a second frequency range content source audio signal, wherein the first additional signal and the second additional signal are substantially different. The adaptive filter may have a response that generates the antinoise signal from the reference microphone signal to reduce the presence of the ambient audio sounds at the acoustic output, wherein the response of the adaptive filter is shaped in conformity with the reference microphone signal and the error microphone signal by adapting the response of the adaptive filter to minimize the ambient audio sounds in the error microphone signal, wherein the antinoise signal is combined with at least the first frequency range content source audio signal.

20 Claims, 4 Drawing Sheets

(52) U.S. Cl.
CPC ..... *G10K 11/17885* (2018.01); *H04R 3/12* (2013.01); *G10K 2210/1081* (2013.01); *H04R 2205/022* (2013.01)

(58) Field of Classification Search
CPC ..... G10K 2210/3027; G10K 2210/506; G10K 2210/3049
USPC ..... 381/71.1, 71.5, 71.6, 71.7, 71.8, 71.9, 381/71.11
See application file for complete search history.

(56) References Cited

U.S. PATENT DOCUMENTS 5,445,517 A 8/1995 Kondou et al.
5,465,413 A 11/1995 Enge et al.
5,481,615 A 1/1996 Eatwell et al.
5,548,681 A 8/1996 Gleaves et al.
5,563,819 A 10/1996 Nelson
5,586,190 A 12/1996 Trantow et al.
5,633,795 A 5/1997 Popovich
5,640,450 A 6/1997 Watanabe
5,668,747 A 9/1997 Ohashi
5,696,831 A 12/1997 Inanaga
5,699,437 A 12/1997 Finn
5,706,344 A 1/1998 Finn
5,740,256 A 4/1998 Castello Da Costa et al.
5,768,124 A 6/1998 Stothers et al.
5,815,582 A 9/1998 Claybaugh et al.
5,832,095 A 11/1998 Daniels
5,909,498 A 6/1999 Smith
5,940,519 A 8/1999 Kuo
5,946,391 A 8/1999 Dragwidge et al.
5,991,418 A 11/1999 Kuo
6,041,126 A 3/2000 Terai et al.
6,118,878 A 9/2000 Jones
6,219,427 B1 4/2001 Kates et al.
6,278,786 B1 8/2001 McIntosh
6,282,176 B1 8/2001 Hemkumar
6,317,501 B1 11/2001 Matsuo
6,418,228 B1 7/2002 Terai et al.
6,434,246 B1 8/2002 Kates et al.
6,434,247 B1 8/2002 Kates et al.
6,522,746 B1 2/2003 Marchok et al.
6,683,960 B1 1/2004 Fuji et al.
6,766,292 B1 7/2004 Chandran et al.
6,768,795 B2 7/2004 Feltstrom et al.
6,850,617 B1 2/2005 Weigand
6,940,982 B1 9/2005 Watkins
7,058,463 B1 6/2006 Ruha et al.
7,103,188 B1 9/2006 Jones
7,181,030 B2 2/2007 Rasmussen et al.
7,330,739 B2 2/2008 Somayajula
7,365,669 B1 4/2008 Melanson
7,406,179 B2 7/2008 Ryan
7,466,838 B1 12/2008 Moseley
7,555,081 B2 6/2009 Keele, Jr.
7,680,456 B2 3/2010 Muhammad et al.
7,742,790 B2 6/2010 Konchitsky et al.
7,817,808 B2 10/2010 Konchitsky et al.
7,885,417 B2 2/2011 Christoph
8,019,050 B2 9/2011 Mactavish et al.
8,144,888 B2 3/2012 Berkhoff et al.
8,155,334 B2 4/2012 Joho et al.
8,249,262 B2 8/2012 Chua et al.
8,254,589 B2 8/2012 Mitsuhata
8,290,537 B2 10/2012 Lee et al.
8,311,243 B2 11/2012 Tucker et al.
8,325,934 B2 12/2012 Kuo
8,374,358 B2 2/2013 Buck et al.
8,379,884 B2 2/2013 Horibe et al.
8,401,200 B2 3/2013 Tiscareno et al.
8,401,204 B2 3/2013 Odent et al.
8,411,872 B2 4/2013 Stothers et al.
8,442,251 B2 5/2013 Jensen et al.
8,526,627 B2 9/2013 Asao et al.
8,526,628 B1 9/2013 Massie et al.
8,532,310 B2 9/2013 Gauger, Jr. et al.
8,539,012 B2 9/2013 Clark
8,848,936 B2 9/2014 Kwatra et al.
8,907,829 B1 12/2014 Naderi
8,908,877 B2 12/2014 Abdollahzadeh Milani et al.
8,909,524 B2 12/2014 Stoltz et al.
8,942,976 B2 1/2015 Li et al.
8,948,407 B2 2/2015 Alderson et al.
8,948,410 B2 2/2015 Van Leest
8,958,571 B2 2/2015 Kwatra et al.
8,977,545 B2 3/2015 Zeng et al.
9,020,160 B2 4/2015 Gauger, Jr.
9,066,176 B2 6/2015 Hendrix et al.
9,082,391 B2 7/2015 Yermech et al.
9,203,366 B2 12/2015 Eastty
9,294,836 B2 3/2016 Zhou et al.
9,392,364 B1 7/2016 Milani et al.
2001/0053228 A1 12/2001 Jones
2002/0003887 A1 1/2002 Zhang et al.
2003/0063759 A1 4/2003 Brennan et al.
2003/0185403 A1 10/2003 Sibbald
2004/0001450 A1 1/2004 He et al.
2004/0017921 A1 1/2004 Mantovani
2004/0047464 A1 3/2004 Yu et al.
2004/0122879 A1 6/2004 McGrath
2004/0165736 A1 8/2004 Hetherington et al.
2004/0167777 A1 8/2004 Hetherington et al.
2004/0196992 A1 10/2004 Ryan
2004/0202333 A1 10/2004 Czermak et al.
2004/0264706 A1 12/2004 Ray et al.
2005/0004796 A1 1/2005 Trump et al.
2005/0018862 A1 1/2005 Fisher
2005/0110568 A1 5/2005 Robinson et al.
2005/0117754 A1 6/2005 Sakawaki
2005/0175187 A1 8/2005 Wright et al.
2005/0207585 A1 9/2005 Christoph
2005/0240401 A1 10/2005 Ebenezer
2006/0013408 A1 1/2006 Lee
2006/0018460 A1 1/2006 McCree
2006/0035593 A1 2/2006 Leeds
2006/0069556 A1 3/2006 Nadjar et al.
2006/0153400 A1 7/2006 Fujita et al.
2007/0030989 A1 2/2007 Kates
2007/0033029 A1 2/2007 Sakawaki
2007/0038441 A1 2/2007 Inoue et al.
2007/0047742 A1 3/2007 Taenzer et al.
2007/0053524 A1 3/2007 Haulick et al.
2007/0076896 A1 4/2007 Hosaka et al.
2007/0154031 A1 7/2007 Avendano et al.
2007/0258597 A1 11/2007 Rasmussen et al.
2007/0297620 A1 12/2007 Choy
2008/0019548 A1 1/2008 Avendano
2008/0101589 A1 5/2008 Horowitz et al.
2008/0107281 A1 5/2008 Togami et al.
2008/0144853 A1 6/2008 Sommerfeldt et al.
2008/0177532 A1 7/2008 Greiss et al.
2008/0181422 A1 7/2008 Christoph
2008/0226098 A1 9/2008 Haulick et al.
2008/0240455 A1 10/2008 Inoue et al.
2008/0240457 A1 10/2008 Inoue et al.
2009/0012783 A1 1/2009 Klein
2009/0034748 A1 2/2009 Sibbald
2009/0041260 A1 2/2009 Jorgensen et al.
2009/0046867 A1 2/2009 Clemow
2009/0060222 A1 3/2009 Jeong et al.
2009/0080670 A1 3/2009 Solbeck et al.
2009/0086990 A1 4/2009 Christoph
2009/0175461 A1 7/2009 Nakamura et al.
2009/0175466 A1 7/2009 Elko et al.
2009/0196429 A1 8/2009 Ramakrishnan et al.
2009/0220107 A1 9/2009 Every et al.
2009/0238369 A1 9/2009 Ramakrishnan et al.
2009/0245529 A1 10/2009 Asada et al.
2009/0254340 A1 10/2009 Sun et al.
2009/0290718 A1 11/2009 Kahn et al.
2009/0296965 A1 12/2009 Kojima
2009/0304200 A1 12/2009 Kim et al.
2009/0311979 A1 12/2009 Husted et al.

(56) References Cited

U.S. PATENT DOCUMENTS

2010/0014683 A1 1/2010 Maeda et al.
2010/0014685 A1 1/2010 Wurm
2010/0061564 A1 3/2010 Clemow et al.
2010/0069114 A1 3/2010 Lee et al.
2010/0082339 A1 4/2010 Konchitsky et al.
2010/0098263 A1 4/2010 Pan et al.
2010/0098265 A1 4/2010 Pan et al.
2010/0124336 A1 5/2010 Shridhar et al.
2010/0124337 A1 5/2010 Wertz et al.
2010/0131269 A1 5/2010 Park et al.
2010/0150367 A1 6/2010 Mizuno
2010/0158330 A1 6/2010 Guissin et al.
2010/0166203 A1 7/2010 Peissig et al.
2010/0195838 A1 8/2010 Bright
2010/0195844 A1 8/2010 Christoph et al.
2010/0207317 A1 8/2010 Iwami et al.
2010/0246855 A1 9/2010 Chen
2010/0266137 A1 10/2010 Sibbald et al.
2010/0272276 A1 10/2010 Carreras et al.
2010/0272283 A1 10/2010 Carreras et al.
2010/0272284 A1 10/2010 Marcel et al.
2010/0274564 A1 10/2010 Bakalos et al.
2010/0284546 A1 11/2010 DeBrunner et al.
2010/0291891 A1 11/2010 Ridgers et al.
2010/0296666 A1 11/2010 Lin
2010/0296668 A1 11/2010 Lee et al.
2010/0310086 A1 12/2010 Magrath et al.
2010/0316225 A1 12/2010 Saito et al.
2010/0322430 A1 12/2010 Isberg
2011/0007907 A1 1/2011 Park et al.
2011/0026724 A1 2/2011 Doclo
2011/0096933 A1 4/2011 Eastty
2011/0099010 A1 4/2011 Zhang
2011/0106533 A1 5/2011 Yu
2011/0129098 A1 6/2011 Delano et al.
2011/0130176 A1 6/2011 Magrath et al.
2011/0142247 A1 6/2011 Fellers et al.
2011/0144984 A1 6/2011 Konchitsky
2011/0150257 A1 6/2011 Jensen
2011/0158419 A1 6/2011 Theverapperuma et al.
2011/0206214 A1 8/2011 Christoph et al.
2011/0222698 A1 9/2011 Asao et al.
2011/0222701 A1 9/2011 Donaldson
2011/0249826 A1 10/2011 Van Leest
2011/0288860 A1 11/2011 Schevciw et al.
2011/0293103 A1 12/2011 Park et al.
2011/0299695 A1 12/2011 Nicholson
2011/0305347 A1 12/2011 Wurm
2011/0317848 A1 12/2011 Ivanov et al.
2012/0057720 A1 3/2012 Van Leest
2012/0084080 A1 4/2012 Konchitsky et al.
2012/0135787 A1 5/2012 Kusunoki et al.
2012/0140917 A1 6/2012 Nicholson et al.
2012/0140942 A1 6/2012 Loeda
2012/0140943 A1 6/2012 Hendrix et al.
2012/0148062 A1 6/2012 Scarlett et al.
2012/0155666 A1 6/2012 Nair
2012/0170766 A1 7/2012 Alves et al.
2012/0179458 A1 7/2012 Oh et al.
2012/0185524 A1 7/2012 Clark
2012/0207317 A1 8/2012 Abdollahzadeh Milani et al.
2012/0215519 A1 8/2012 Park et al.
2012/0250873 A1 10/2012 Bakalos et al.
2012/0259626 A1 10/2012 Li et al.
2012/0263317 A1 10/2012 Shin et al.
2012/0300958 A1 11/2012 Klemmensen
2012/0300960 A1 11/2012 Mackay et al.
2012/0308021 A1 12/2012 Kwatra et al.
2012/0308024 A1 12/2012 Alderson et al.
2012/0308025 A1 12/2012 Hendrix et al.
2012/0308026 A1 12/2012 Karnath et al.
2012/0308027 A1 12/2012 Kwatra
2012/0308028 A1 12/2012 Kwatra et al.
2012/0310640 A1 12/2012 Kwatra et al.
2012/0316872 A1 12/2012 Stoltz et al.
2013/0010982 A1 1/2013 Elko et al.
2013/0022213 A1 1/2013 Alcock
2013/0083939 A1 4/2013 Fellers et al.
2013/0156238 A1 6/2013 Birch et al.
2013/0182792 A1 7/2013 Wyville
2013/0243198 A1 9/2013 Van Rumpt
2013/0243225 A1 9/2013 Yokota
2013/0259251 A1 10/2013 Bakalos
2013/0272539 A1 10/2013 Kim et al.
2013/0287218 A1 10/2013 Alderson et al.
2013/0287219 A1 10/2013 Hendrix et al.
2013/0301842 A1 11/2013 Hendrix et al.
2013/0301846 A1 11/2013 Alderson et al.
2013/0301847 A1 11/2013 Alderson et al.
2013/0301848 A1 11/2013 Zhou et al.
2013/0301849 A1 11/2013 Alderson
2013/0315403 A1 11/2013 Samuelsson
2013/0343556 A1 12/2013 Bright
2013/0343571 A1 12/2013 Rayala et al.
2014/0044275 A1 2/2014 Goldstein et al.
2014/0050332 A1 2/2014 Nielsen et al.
2014/0072135 A1 3/2014 Bajic et al.
2014/0086425 A1 3/2014 Jensen et al.
2014/0126735 A1 5/2014 Gauger, Jr.
2014/0169579 A1 6/2014 Azmi
2014/0177851 A1 6/2014 Kitazawa et al.
2014/0177890 A1 6/2014 Hojlund et al.
2014/0211953 A1 7/2014 Alderson et al.
2014/0226827 A1 8/2014 Abdollahzadeh Milani et al.
2014/0270223 A1 9/2014 Li et al.
2014/0270224 A1 9/2014 Zhou et al.
2014/0277022 A1 9/2014 Hendrix et al.
2014/0294182 A1 10/2014 Axelsson
2014/0307887 A1 10/2014 Alderson et al.
2014/0307888 A1 10/2014 Alderson et al.
2014/0307890 A1 10/2014 Zhou et al.
2014/0307899 A1 10/2014 Hendrix et al.
2014/0314244 A1 10/2014 Yong et al.
2014/0314246 A1 10/2014 Hellman
2014/0314247 A1 10/2014 Zhang
2014/0341388 A1 11/2014 Goldstein
2014/0369517 A1 12/2014 Zhou et al.
2015/0078572 A1 3/2015 Abdollahzadeh Milani et al.
2015/0092953 A1 4/2015 Abdollahzadeh Milani et al.
2015/0104032 A1 4/2015 Kwatra et al.
2015/0161980 A1 6/2015 Alderson et al.
2015/0161981 A1 6/2015 Kwatra
2015/0163592 A1 6/2015 Alderson
2015/0195646 A1 7/2015 Kumar et al.
2016/0180830 A1 6/2016 Lu et al.

FOREIGN PATENT DOCUMENTS

EP 0412902 A2 2/1991
EP 0756407 A2 1/1997
EP 0898266 A2 2/1999
EP 1691577 A2 8/2006
EP 1880699 A2 1/2008
EP 1921603 A2 5/2008
EP 1947642 A1 7/2008
EP 2133866 A1 12/2009
EP 2259250 A1 12/2010
EP 2216774 A1 8/2011
EP 2395500 A1 12/2011
EP 2395501 A1 12/2011
EP 2551845 A1 1/2013
EP 2583074 A1 4/2013
GB 2401744 A 11/2004
GB 246657 A 10/2007
GB 2455821 A 6/2009
GB 2455824 A 6/2009
GB 2455828 A 6/2009
GB 2484722 A 4/2012
GB 2539280 A 12/2016
JP H05265468 10/1993
JP 06006246 1/1994
JP H06186985 A 7/1994
JP H06232755 8/1994
JP 07098592 4/1995

(56) References Cited

FOREIGN PATENT DOCUMENTS

| | | | |
|---|---|---|---|
| JP | H0732558 | A | 12/1995 |
| JP | H07334169 | | 12/1995 |
| JP | H08227322 | | 9/1996 |
| JP | H1032891 | A | 2/1998 |
| JP | H10247088 | | 9/1998 |
| JP | H10257159 | | 9/1998 |
| JP | H11305783 | A | 11/1999 |
| JP | 2000059876 | A | 2/2000 |
| JP | 2000089770 | | 3/2000 |
| JP | 2002010355 | | 1/2002 |
| JP | 2004007107 | | 1/2004 |
| JP | 2006217542 | A | 8/2006 |
| JP | 2007060644 | | 3/2007 |
| JP | 2008015046 | A | 1/2008 |
| JP | 2008124564 | A | 5/2008 |
| JP | 2010277025 | | 12/2010 |
| JP | 2011061449 | | 3/2011 |
| WO | 93/04529 | A1 | 3/1993 |
| WO | 94/07212 | A1 | 3/1994 |
| WO | 2003015074 | A1 | 2/2003 |
| WO | 2003015275 | A1 | 2/2003 |
| WO | 2004009007 | A1 | 1/2004 |
| WO | 2004017303 | A1 | 2/2004 |
| WO | 2006125061 | A1 | 11/2006 |
| WO | 2006128768 | A1 | 12/2006 |
| WO | 2007007916 | A1 | 1/2007 |
| WO | 2007011337 | A1 | 1/2007 |
| WO | 2007110807 | A2 | 10/2007 |
| WO | 2007113487 | A1 | 11/2007 |
| WO | 2009041012 | A1 | 4/2009 |
| WO | 2009110087 | A1 | 9/2009 |
| WO | 2009155696 | A1 | 12/2009 |
| WO | 2010117714 | A1 | 10/2010 |
| WO | 2011035061 | A1 | 3/2011 |
| WO | 2012134874 | A1 | 10/2012 |
| WO | 2012166273 | A2 | 12/2012 |
| WO | 2012166388 | A1 | 12/2012 |
| WO | 2013106370 | A1 | 7/2013 |
| WO | 2014158475 | A1 | 10/2014 |
| WO | 2014168685 | A1 | 10/2014 |
| WO | 2014172005 | A1 | 10/2014 |
| WO | 2014172006 | A1 | 10/2014 |
| WO | 2014172010 | A1 | 10/2014 |
| WO | 2014172019 | A1 | 10/2014 |
| WO | 2014172021 | A1 | 10/2014 |
| WO | 2014200787 | A1 | 12/2014 |
| WO | 2015038255 | A1 | 3/2015 |
| WO | 2015088639 | A | 6/2015 |
| WO | 2015088639 | A1 | 6/2015 |
| WO | 2015088651 | A | 6/2015 |
| WO | 2015088651 | A1 | 6/2015 |
| WO | 2015088653 | A1 | 6/2015 |
| WO | 2015191691 | A1 | 12/2015 |
| WO | 2016054186 | A1 | 4/2016 |
| WO | 2016100602 | A1 | 6/2016 |
| WO | 2016198481 | A2 | 12/2016 |
| WO | 2017035000 | A1 | 3/2017 |

OTHER PUBLICATIONS

International Patent Application No. PCT/US2014/060277, International Search Report and Written Opinion, dated Mar. 9, 2015, 11 pages.

Ray, Laura et al., Hybrid Feedforward-Feedback Active Noise Reduction for Hearing Protection and Communication, The Journal of the Acoustical Society of America, American Institute of Physics for the Acoustical Society of America, New York, NY, vol. 120, No. 4, Jan. 2006, pp. 2026-2036.

International Patent Application No. PCT/US2014/017112, International Search Report and Written Opinion, dated May 8, 2015, 22 pages.

International Patent Application No. PCT/US2015/017124, International Search Report and Written Opinion, dated Jul. 13, 2015, 19 pages.

International Patent Application No. PCT/US2015/035073, International Search Report and Written Opinion, dated Oct. 8, 2015, 11 pages.

Kou, Sen and Tsai, Jianming, Residual noise shaping technique for active noise control systems, J. Acoust. Soc. Am. 95 (3), Mar. 1994, pp. 1665-1668.

Pfann, et al., "LMS Adaptive Filtering with Delta-Sigma Modulated Input Signals," IEEE Signal Processing Letters, Apr. 1998, pp. 95-97, vol. 5, No. 4, IEEE Press, Piscataway, NJ.

Toochinda, et al., "A Single-Input Two-Output Feedback Formulation for ANC Problems," Proceedings of the 2001 American Control Conference, Jun. 2001, pp. 923-928, vol. 2, Arlington, VA.

Kuo, et al., "Active Noise Control: A Tutorial Review," Proceedings of the IEEE, Jun. 1999, pp. 943-973, vol. 87, No. 6, IEEE Press, Piscataway, NJ.

Johns, et al., "Continuous-Time LMS Adaptive Recursive Filters," IEEE Transactions on Circuits and Systems, Jul. 1991, pp. 769-778, vol. 38, No. 7, IEEE Press, Piscataway, NJ.

Shoval, et al., "Comparison of DC Offset Effects in Four LMS Adaptive Algorithms," IEEE Transactions on Circuits and Systems II: Analog and Digital Processing, Mar. 1995, pp. 176-185, vol. 42, Issue 3, IEEE Press, Piscataway, NJ.

Mali, Dilip, "Comparison of DC Offset Effects on LMB Algorithm and its Derivatives," International Journal of Recent Trends in Engineering, May 2009, pp. 323-328, vol. 1, No. 1, Academy Publisher.

Kates, James M., "Principles of Digital Dynamic Range Compression," Trends in Amplification, Spring 2005, pp. 45-76, vol. 9, No. 2, Sage Publications.

Gao, et al., "Adaptive Linearization of a Loudspeaker," IEEE International Conference on Acoustics, Speech, and Signal Processing, Apr. 14-17, 1991, pp. 3589-3592, Toronto, Ontario, CA.

Silva, et al., "Convex Combination of Adaptive Filters With Different Tracking Capabilities," IEEE International Conference on Acoustics, Speech, and Signal Processing, Apr. 15-20, 2007, pp. III 925-928, vol. 3, Honolulu, HI, USA.

Akhtar, et al., "A Method for Online Secondary Path Modeling in Active Noise Control Systems," IEEE International Symposium on Circuits and Systems, May 23-26, 2005, pp. 264-267, vol. 1, Kobe, Japan.

Davari, et al., "A New Online Secondary Path Modeling Method for Feedforward Active Noise Control Systems," IEEE International Conference on Industrial Technology, Apr. 21-24, 2008, pp. 1-6, Chengdu, China.

Lan, et al., "An Active Noise Control System Using Online Secondary Path Modeling With Reduced Auxiliary Noise," IEEE Signal Processing Letters, Jan. 2002, pp. 16-18, vol. 9, Issue 1, IEEE Press, Piscataway, NJ.

Liu, et al., "Analysis of Online Secondary Path Modeling With Auxiliary Noise Scaled by Residual Noise Signal," IEEE Transactions on Audio, Speech and Language Processing, Nov. 2010, pp. 1978-1993, vol. 18, Issue 8, IEEE Press, Piscataway, NJ.

Booji, P.S., Berkhoff, A.P., Virtual sensors for local, three dimensional, broadband multiple-channel active noise control and the effects on the quiet zones, Proceedings of ISMA2010 including USD2010, pp. 151-166.

Lopez-Caudana, Edgar Omar, Active Noise Cancellation: The Unwanted Signal and The Hybrid Solution, Adaptive Filtering Applications, Dr. Lino Garcia, ISBN: 978-953-307-306-4, InTech.

D. Senderowicz et al., "Low-Voltage Double-Sampled Delta-Sigma Converters," IEEE J. Solid-State Circuits, vol. 32,, No. 12, pp. 1907-1919, Dec. 1997, 13 pages.

Hurst, P.J. and Dyer, K.C., "An improved double sampling scheme for switched-capacitor delta-sigma modulators," IEEE Int. Symp. Circuits Systems, May 1992, vol. 3, pp. 1179-1182, 4 pages.

Milani, et al., "On Maximum Achievable Noise Reduction in ANC Systems", Proceedings of the IEEE International Conference on Acoustics, Speech, and Signal Processing, ICASSP 2010, Mar. 14-19, 2010 pp. 349-352.

Ryan, et al., "Optimum near-field performance of microphone arrays subject to a far-field beampattern constraint", 2248 J. Acoust. Soc. Am. 108, Nov. 2000.

Cohen, et al., "Noise Estimation by Minima Controlled Recursive Averaging for Robust Speech Enhancement", IEEE Signal Processing Letters, vol. 9, No. 1, Jan. 2002.

(56) References Cited

OTHER PUBLICATIONS

Martin, "Noise Power Spectral Density Estimation Based on Optimal Smoothing and Minimum Statistics", IEEE Trans. on Speech and Audio Processing, col. 9, No. 5, Jul. 2001.
Martin, "Spectral Subtraction Based on Minimum Statistics", Proc. 7th EUSIPCO '94, Edinburgh, U.K., Sep. 13-16, 1994, pp. 1182-1195.
Cohen, "Noise Spectrum Estimation in Adverse Environments: Improved Minima Controlled Recursive Averaging", IEEE Trans. on Speech & Audio Proc., vol. 11, Issue 5, Sep. 2003.
Black, John W., "An Application of Side-Tone in Subjective Tests of Microphones and Headsets", Project Report No. NM 001 064. 01.20, Research Report of the U.S. Naval School of Aviation Medicine, Feb. 1, 1954, 12 pages (pp. 1-12 in pdf), Pensacola, FL, US.
Lane, et al., "Voice Level: Autophonic Scale, Perceived Loudness, and the Effects of Sidetone", The Journal of the Acoustical Society of America, Feb. 1961, pp. 160-167, vol. 33, No. 2., Cambridge, MA, US.
Liu, et al., "Compensatory Responses to Loudness-shifted Voice Feedback During Production of Mandarin Speech", Journal of the Acoustical Society of America, Oct. 2007, pp. 2405-2412, vol. 122, No. 4.
Paepcke, et al., "Yelling in the Hall: Using Sidetone to Address a Problem with Mobile Remote Presence Systems", Symposium on User Interface Software and Technology, Oct. 16-19, 2011, 10 pages (pp. 1-10 in pdf), Santa Barbara, CA, US.
Peters, Robert W., "The Effect of High-Pass and Low-Pass Filtering of Side-Tone Upon Speaker Intelligibility", Project Report No. NM 001 064.01.25, Research Report of the U.S. Naval School of Aviation Medicine, Aug. 16, 1954, 13 pages (pp. 1-13 in pdf), Pensacola, FL, US.
Therrien, et al., "Sensory Attenuation of Self-Produced Feedback: The Lombard Effect Revisited", PLOS ONE, Nov. 2012, pp. 1-7, vol. 7, Issue 11, e49370, Ontario, Canada.
Campbell, Mikey, "Apple looking into self-adjusting earbud headphones with noise cancellation tech", Apple Insider, Jul. 4, 2013, pp. 1-10 (10 pages in pdf), downloaded on May 14, 2014 from http://appleinsider.com/articles/13/07/04/apple-looking-into-self-adjusting-earbud-headphones-with-noise-cancellation-tech.
International Patent Application No. PCT/US2014/017096, International Search Report and Written Opinion, dated May 27, 2014, 11 pages.
Jin, et al., "A simultaneous equation method-based online secondary path modeling algorithm for active noise control", Journal of Sound and Vibration, Apr. 25, 2007, pp. 455-474, vol. 303, No. 3-5, London, GB.
Erkelens et al., "Tracking of Nonstationary Noise Based on Data-Driven Recursive Noise Power Estimation", IEEE Transactions on Audio Speech, and Language Processing, vol. 16, No. 6, Aug. 2008.
Rao et al., "A Novel Two Stage Single Channle Speech Enhancement Technique", India Conference (INDICON) 2011 Annual IEEE, IEEE, Dec. 15, 2011.
Rangachari et al., "A noise-estimation algorithm for highly non-stationary environments" Speech Communication, Elsevier Science Publishers, vol. 48, No. 2, Feb. 1, 2006.
International Search Report and Written Opinion of the International Searching Authority, International Patent Application No. PCT/US2014/017343, dated Aug. 5, 2014, 22 pages.
International Search Report and Written Opinion of the International Searching Authority, International Patent Application No. PCT/US2014/018027, dated Sep. 4, 2014, 14 pages.
International Search Report and Written Opinion of the International Searching Authority, International Patent Application No. PCT/US2014/017374, dated Sep. 8, 2014, 13 pages.
International Search Report and Written Opinion of the International Searching Authority, International Patent Application No. PCT/US2014/019395, dated Sep. 9, 2014, 12 pages.
International Search Report and Written Opinion of the International Searching Authority, International Patent Application No. PCT/US2014/019469, dated Sep. 12, 2014, 13 pages.
Feng, Jinwei et al., "A broadband self-tuning active noise equaliser", Signal Processing, Elsevier Science Publishers B.V. Amsterdam, NL, vol. 62, No. 2, Oct. 1, 1997, pp. 251-256.
Zhang, Ming et al., "A Robust Online Secondary Path Modeling Method with Auxiliary Noise Power Scheduling Strategy and Norm Constraint Manipulation", IEEE Transactions on Speech and Audio Processing, IEEE Service Center, New York, NY, vol. 11, No. 1, Jan. 1, 2003.
Lopez-Gaudana, Edgar et al., "A hybrid active noise cancelling with secondary path modeling", 51st Midwest Symposium on Circuits and Systems, 2008, MWSCAS 2008, Aug. 10, 2008, pp. 277-280.
Widrow, B. et al., Adaptive Noise Cancelling: Principles and Applications, Proceedings of the IEEE, IEEE, New York, NY, U.S., vol. 63, No. 13, Dec. 1975, pp. 1692-1716.
Morgan, Dennis R. et al., A Delayless Subband Adaptive Filter Architecture, IEEE Transactions on Signal Processing, IEEE Service Center, New York, NY, U.S., vol. 43, No. 8, Aug. 1995, pp. 1819-1829.
International Patent Application No. PCT/US2014/040999, International Search Report and Written Opinion, dated Oct. 28, 2014, 12 pages.
International Patent Application No. PCT/US2013/049407, International Search Report and Written Opinion, dated Jun. 18, 2014, 13 pages.
International Patent Application No. PCT/US2014/049600, International Search Report and Written Opinion, dated Jan. 14, 2015, 12 pages.
International Patent Application No. PCT/US2014/061753, International Search Report and Written Opinion, dated Feb. 9, 2015, 8 pages.
Combined Search and Examination Report under Sections 17 and 18(3), United Kingdom Application No. GB1611064.5, dated Dec. 28, 2016.
Combined Search and Examination Report under Sections 17 and 18(3), United Kingdom Application No. GB1611080.1, dated Dec. 28, 2016.
International Search Report and Written Opinion of the International Searching Authority, International Application No. PCT/US2016/047828, dated Dec. 1, 2016.
International Search Report and Written Opinion of the International Searching Authority, International Application No. PCT/US2016/039523, dated Dec. 7, 2016.
Wu, Lifu et al., "Decoupling feedforward and feedback structures in hybrid active noise control systems for uncorrelated narrowband disturbances", Journal of Sound and Vibration, vol. 350, Aug. 18, 2015, pp. 1-10, Section 2, figures 1-3.
Lopez-Caudana, Edgar et al., "A Hybrid Noise Cancelling Algorithm with Secondary Path Estimation", WSEAS Transactions on Signal Processing, vol. 4, No. 12, Dec. 1, 2008, pp. 677-687, Sections 2 and 3, figures 4-8.
International Search Report and Written Opinion of the International Searching Authority, International Application No. PCT/EP2016/063079, dated Dec. 12, 2016.
Goeckler, H.G. et al.: Efficient Multirate Digital Filters Based on Fractional Polyphase Decomposition for Subnyquist Processing, Proceedings of the European Conference on Circuit Theory and Design, vol. 1, Jan. 1, 1999, pp. 409-412.
Examination Report under Section 18(3), United Kingdom Application No. GB1512832.5, dated Feb. 2, 2017.
Combined Search and Examination Report, Application No. GB1512832.5, dated Jan. 28, 2016, 7 pages.
International Patent Application No. PCT/US2015/066260, International Search Report and Written Opinion, dated Apr. 21, 2016, 13 pages.
English machine translation of JP 2006-217542 A (Okumura, Hiroshi; Howling Suppression Device and Loudspeaker, published Aug. 2006).
Combined Search and Examination Report, Application No. GB1519000.2, dated Apr. 21, 2016, 5 pages.

SYSTEMS AND METHODS FOR ADAPTIVE ACTIVE NOISE CANCELLATION FOR MULTIPLE-DRIVER PERSONAL AUDIO DEVICE

FIELD OF DISCLOSURE

The present disclosure relates in general to adaptive noise cancellation in connection with an acoustic transducer, and more particularly, to detection and cancellation of ambient noise present in the vicinity of the acoustic transducer, and particularly for the cancellation of ambient noise in an audio system including multiple drivers for differing frequency bands.

BACKGROUND

Wireless telephones, such as mobile/cellular telephones, cordless telephones, and other consumer audio devices, such as mp3 players, are in widespread use. Performance of such devices with respect to intelligibility can be improved by providing noise cancelling using a microphone to measure ambient acoustic events and then using signal processing to insert an antinoise signal into the output of the device to cancel the ambient acoustic events.

While many audio systems implemented for personal audio devices rely on a single output transducer, in the case of transducers mounted on the housing of a wireless telephone, or a pair of transducers when earspeakers are used or when a wireless telephone or other device employs stereo speakers, for high quality audio reproduction, it may be desirable to provide separate transducers for high and low frequencies, as in high quality earspeakers. However, when implementing active noise cancellation (ANC) in traditional systems, crossover filters present in an earspeaker housing may be present in the antinoise path, and thus may introduce latencies in the antinoise path, which may reduce the effectiveness of the ANC system.

Accordingly, it may be desirable to provide for a multiple transducer driver system that minimizes or reduces such latencies.

SUMMARY

In accordance with the teachings of the present disclosure, certain disadvantages and problems associated with existing approaches to adaptive active noise cancellation may be reduced or eliminated.

In accordance with embodiments of the present disclosure, an integrated circuit for implementing at least a portion of a personal audio device may include a first output, a second output, a reference microphone input, an error microphone, and a processing circuit. The first output may provide a first output signal to a first transducer for reproducing a first frequency range content source audio signal comprising first frequency range content of a source audio signal, the first output signal including both the first frequency range content source audio signal and an antinoise signal for countering the effects of ambient audio sounds in an acoustic output of an earspeaker comprising the first transducer and a second transducer. The second output may provide a second output signal to the second transducer for reproducing a second frequency range content source audio signal comprising second frequency range content of the source audio signal, the second output signal including at least the second frequency range content source audio signal. The reference microphone may be configured to receive a reference microphone signal indicative of the ambient audio sounds. The error microphone input may be configured to receive an error microphone signal indicative of the output of the earspeaker and the ambient audio sounds at the earspeaker. The processing circuit may include an adaptive filter, a first signal injection portion which injects a first additional signal into the first frequency range content source audio signal, and a second signal injection portion which injects a second additional signal into the second frequency range content source audio signal, wherein the first additional signal and the second additional signal are substantially different. The adaptive filter may have a response that generates the antinoise signal from the reference microphone signal to reduce the presence of the ambient audio sounds at the acoustic output, wherein the response of the adaptive filter is shaped in conformity with the reference microphone signal and the error microphone signal by adapting the response of the adaptive filter to minimize the ambient audio sounds in the error microphone signal.

In accordance with embodiments of the present disclosure, a method may include generating a source audio signal for playback to a listener, receiving a reference microphone signal indicative of ambient audio sounds, receiving an error microphone signal indicative of an output of an earspeaker and the ambient audio sounds at the earspeaker, wherein the earspeaker comprises a first transducer for reproducing a first frequency range content source audio signal comprising first frequency range content of the source audio signal and a second transducer for reproducing a second frequency range content source audio signal comprising second frequency range content of the source audio signal, adaptively generating an antinoise signal for countering the effects of ambient audio sounds at an acoustic output of the earspeaker by adapting a response of an adaptive filter that filters the reference microphone signal in conformity with the error microphone signal and the reference microphone signal to minimize the ambient audio sounds in the error microphone signal, injecting a first additional signal into the first frequency range content source audio signal, injecting a second additional signal into the second frequency range content source audio signal, wherein the first additional signal and the second additional signal are substantially different, combining the antinoise signal with the first frequency range content source audio signal to generate a first output signal provided to the first transducer, and generating a second output signal provided to the second transducer, the second output signal including at least the second frequency range content source audio signal.

Technical advantages of the present disclosure may be readily apparent to one of ordinary skill in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

The present disclosure encompasses noise cancelling techniques and circuits that can be implemented in a personal audio system, such as a wireless telephone and connected earbuds. The personal audio system may include an adaptive noise cancellation (ANC) circuit that may measure and attempt to cancel the ambient acoustic environment at the earbuds or another output transducer location such as on the housing of a personal audio device that receives or generates the source audio signal. Multiple transducers may be used, including a low-frequency and a high-frequency transducer that reproduce corresponding frequency bands of the source audio to provide a high quality audio output. The ANC circuit may generate one or more antinoise signals which may be respectively provided to one or more of the multiple transducers, to cancel ambient acoustic events at the transducers. A reference microphone may be provided to measure the ambient acoustic environment, which provides an input to one or more adaptive filters that may generate the one or more antinoise signals.

Figure 1A:
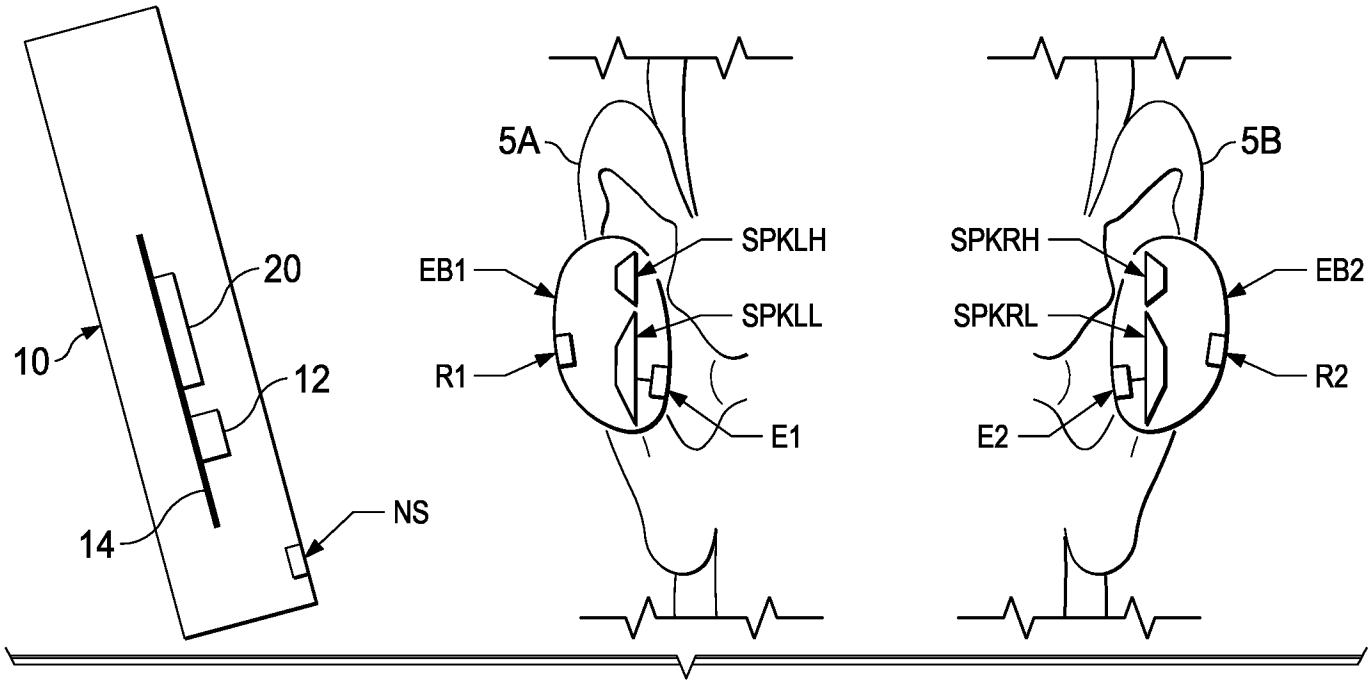
FIG. 1A is an illustration of an example wireless telephone and a pair of earbuds, in accordance with embodiments of the present disclosure.

FIG. 1A illustrates a wireless telephone 10 and a pair of earbuds EB1 and EB2, each attached to a corresponding ear 5A, 5B of a listener, in accordance with embodiments of the present disclosure. Wireless telephone 10 may be an example of a device in which the techniques disclosed herein may be employed, but it is understood that not all of the elements or configurations illustrated in wireless telephone 10, or in the circuits depicted in subsequent illustrations, are required. Wireless telephone 10 may be coupled to earbuds EB1, EB2 by a wired or wireless connection (e.g., a BLUETOOTH™ connection). Earbuds EB1, EB2 may each have a corresponding pair of transducers SPKLH/SPKLL and SPKRH/SPKRL, respectively, which may reproduce source audio including distant speech received from wireless telephone 10, ringtones, stored audio program material, and injection of near-end speech (i.e., the speech of the user of wireless telephone 10). Transducers SPKLH and SPKRH may comprise high-frequency transducers or "tweeters" that reproduce the higher range of audible frequencies and transducers SPKLL and SPKRL may comprise low-frequency transducers or "woofers" that reproduce a lower range of audio frequencies. The source audio may also include any other audio that wireless telephone 10 is to reproduce, such as source audio from webpages or other network communications received by wireless telephone 10 and audio alerts, such as battery low and other system event notifications. Reference microphones R1, R2 may be provided on a surface of a housing of respective earbuds EB1, EB2 for measuring the ambient acoustic environment. Another pair of microphones, error microphones E1, E2, may be provided in order to further improve the ANC operation by providing a measure of the ambient audio combined with the audio reproduced by respective transducer pairs SPKLH/SPKLL and SPKRH/SPKRL close to corresponding ears 5A, 5B, when earbuds EB1, EB2 are inserted in the outer portion of ears 5A, 5B.

Wireless telephone 10 may include ANC circuits and features that inject antinoise signals into one or more of transducers SPKLH, SPKLL, SPKRH and SPKRL to improve intelligibility of the distant speech and other audio reproduced by transducers SPKLH, SPKLL, SPKRH and SPKRL. A circuit 14 within wireless telephone 10 may include an audio integrated circuit 20 that receives the signals from reference microphones R1, R2, a near speech microphone NS, and error microphones E1, E2 and interfaces with other integrated circuits, such as an RF integrated circuit 12 containing the wireless telephone transceiver. In other implementations, the circuits and techniques disclosed herein may be incorporated in a single integrated circuit that comprises control circuits and other functionality for implementing the entirety of the personal audio device, such as, for example, an MP3 player-on-a-chip integrated circuit. Alternatively, the ANC circuits may be included within the housing of earbuds EB1, EB2 or in a module located along wired connections between wireless telephone 10 and earbuds EB1, EB2. For the purposes of illustration, the ANC circuits may be described as provided within wireless telephone 10, but the above variations are understandable by a person of ordinary skill in the art and the consequent signals that are required between earbuds EB1, EB2, wireless telephone 10, and a third module, if required, can be easily determined for those variations. Near speech microphone NS may be provided at a housing of wireless telephone 10 to capture near-end speech, which may be transmitted from wireless telephone 10 to the other conversation participant(s). Alternatively, near speech microphone NS may be provided on the outer surface of the housing of one of earbuds EB1, EB2, on a boom affixed to one of earbuds EB1, EB2, on a pendant located between wireless telephone 10 and either or both of earbuds EB1, EB2, or other suitable location.

Figure 1B:
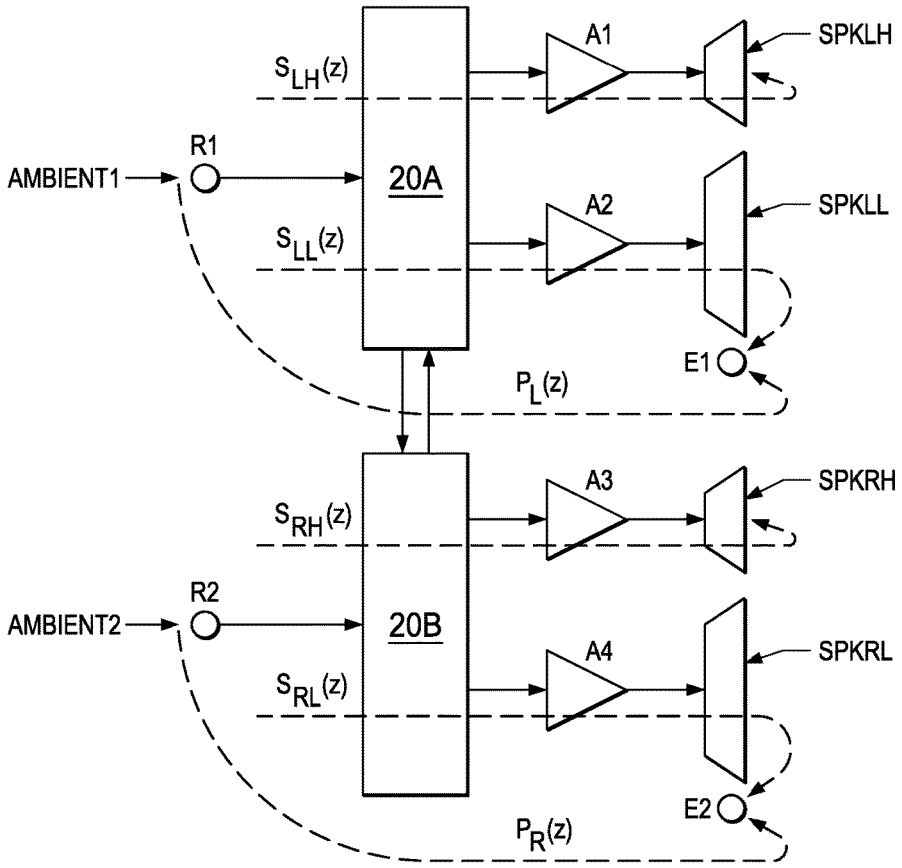
FIG. 1B is a schematic diagram of selected circuits within the wireless telephone depicted in FIG. 1A, in accordance with embodiments of the present disclosure.

FIG. 1B illustrates a simplified schematic diagram of audio integrated circuits 20A, 20B that include ANC processing, as coupled to reference microphones R1, R2, which provide a measurement of ambient audio sounds Ambient1, Ambient2 which may be filtered by ANC processing circuits within audio integrated circuits 20A, 20B located within corresponding earbuds EB1, EB2, or within a single integrated circuit such as integrated circuit 20 which combines audio integrated circuits 20A and 20B within wireless telephone 10. Audio integrated circuits 20A, 20B may generate outputs for their corresponding channels that are amplified by an associated one of amplifiers A1-A4 and which are provided to the corresponding transducer pairs SPKLH/SPKLL and SPKRH/SPKRL. Audio integrated circuits 20A, 20B may receive the signals (wired or wireless depending on the particular configuration) from reference microphones R1, R2, near speech microphone NS and error microphones E1, E2. Audio integrated circuits 20A, 20B may also interface with other integrated circuits such as RF integrated circuit 12 which may comprise a wireless telephone transceiver as shown in FIG. 1A. In other configurations, the circuits and techniques disclosed herein may be incorporated in a single integrated circuit that includes control circuits and other functionality for implementing the entirety of the personal audio device, such as an MP3 player-on-a-chip integrated circuit. Alternatively, multiple integrated circuits may be used, for example, when a wireless connection is provided from each of earbuds EB1, EB2 to wireless telephone 10 and/or when some or all of the ANC processing is performed within earbuds EB1, EB2 or a module disposed along a cable connecting wireless telephone 10 to earbuds EB1, EB2.

In general, the ANC techniques illustrated herein may measure ambient acoustic events (as opposed to the output of transducers SPKLH, SPKLL, SPKRH and SPKRL and/or the near-end speech) impinging on reference microphones R1, R2 and may also measure the same ambient acoustic events impinging on error microphones E1, E2. The ANC processing circuits of integrated circuits 20A, 20B may individually adapt an antinoise signal generated from the output of the corresponding reference microphone R1, R2 to have a characteristic that minimizes the amplitude of the ambient acoustic events at the corresponding error microphone E1, E2. Because acoustic path $P_L(z)$ extends from reference microphone R1 to error microphone E1, the ANC circuit in audio integrated circuit 20A may estimate acoustic path $P_L(z)$ and remove effects of electro-acoustic paths $S_{LH}(z)$ and $S_{LL}(z)$ that represent, respectively, the response of the audio output circuits of audio integrated circuit 20A and the acoustic/electric transfer function of transducers SPKLH and SPKLL. The estimated responses $S_{LH}(z)$ and $S_{LL}(z)$ may include the coupling between transducers SPKLH, SPKLL and error microphone E1 in the particular acoustic environment which may be affected by the proximity and structure of ear 5A and other physical objects and human head structures that may be in proximity to earbud EB1. Similarly, audio integrated circuit 20B may estimate acoustic path $P_R(z)$ and remove effects of electro-acoustic paths $S_{RH}(z)$ and $S_{RL}(z)$ that represent, respectively, the response of the audio output circuits of audio integrated circuit 20B and the acoustic/electric transfer function of transducers SPKRH and SPKRL.

Figure 2:
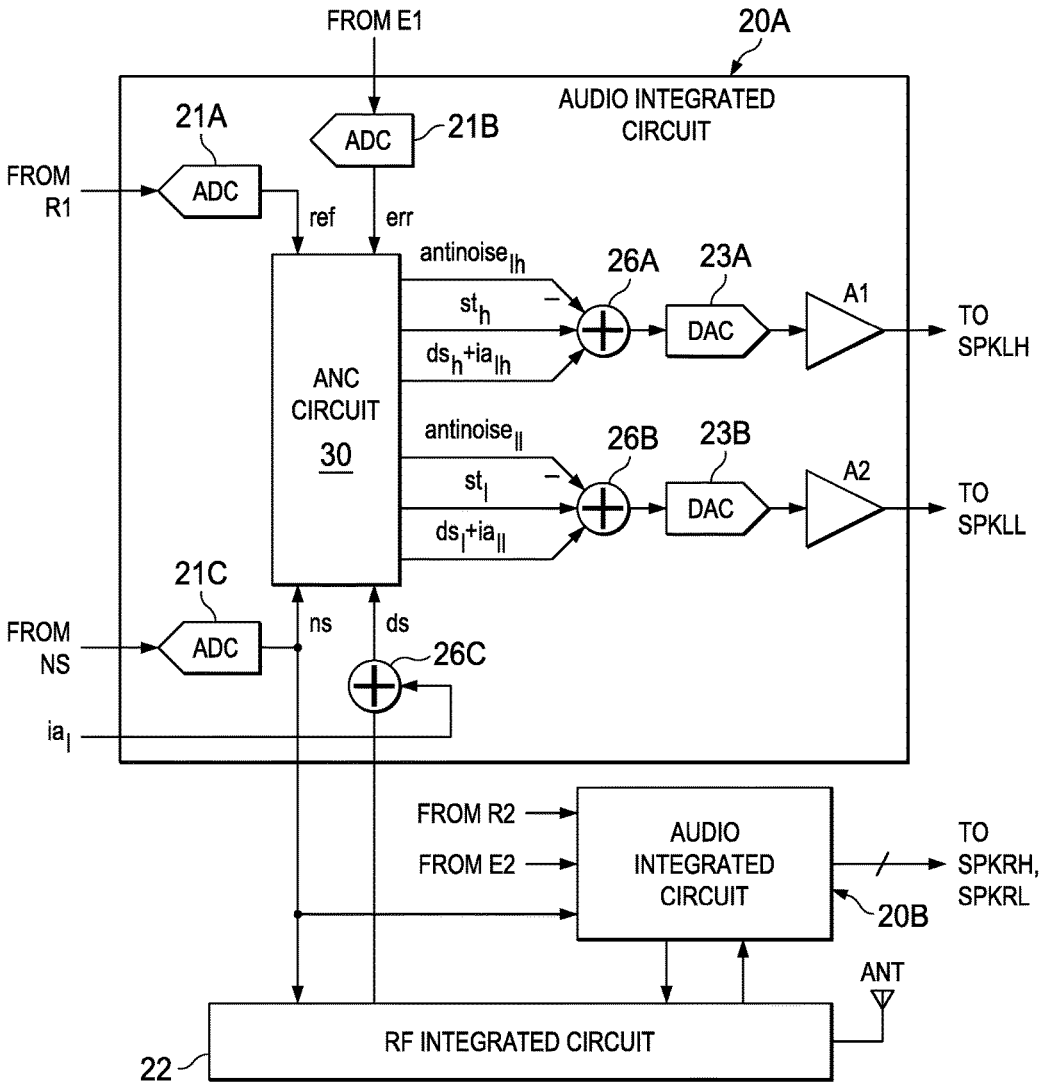
FIG. 2 is a block diagram of selected circuits within the wireless telephone depicted in FIG. 1A, in accordance with embodiments of the present disclosure.

Referring now to FIG. 2, circuits within earbuds EB1, EB2 and/or wireless telephone 10 are shown in a block diagram, in accordance with embodiments of the present disclosure. The circuit shown in FIG. 2 may further apply to other configurations mentioned above, except that signaling between CODEC integrated circuit 20 and other units within wireless telephone 10 may be provided by cables or wireless connections when audio integrated circuits 20A, 20B are located outside of wireless telephone 10, e.g., within corresponding earbuds EB1, EB2. In such a configuration, signaling between a single integrated circuit 20 that implements integrated circuits 20A-20B and error microphones E1, E2, reference microphones R1, R2 and transducers SPKLH, SPKLL, SPKRH and SPKRL may be provided by wired or wireless connections when audio integrated circuit 20 is located within wireless telephone 10. In the illustrated example, audio integrated circuits 20A, 20B are shown as separate and substantially identical circuits, so only audio integrated circuit 20A will be described in detail below.

Audio integrated circuit 20A may include an analog-to-digital converter (ADC) 21A for receiving the reference microphone signal from reference microphone R1 and generating a digital representation ref of the reference microphone signal. Audio integrated circuit 20A may also include an ADC 21B for receiving the error microphone signal from error microphone E1 and generating a digital representation err of the error microphone signal, and an ADC 21C for receiving the near speech microphone signal from near speech microphone NS and generating a digital representation of near speech microphone signal ns. (Audio integrated circuit 20B may receive the digital representation of near speech microphone signal ns from audio integrated circuit 20A via the wireless or wired connections as described above.) Audio integrated circuit 20A may generate an output for driving transducer SPKLH from an amplifier A1, which may amplify the output of a digital-to-analog converter (DAC) 23A that receives the output of a combiner 26A. A combiner 26C may combine downlink speech ds, which may be received from a radio frequency (RF) integrated circuit 22, and left-channel internal audio signal $ia_l$, which as so combined may comprise a left-channel source audio signal. Combiner 26A may combine source audio signal $ds_h+ia_{lh}$, which is the high-frequency band component of the output of combiner 26C with high-frequency band antinoise signal $antinoise_{lh}$ generated by a left-channel ANC circuit 30, which by convention has the same polarity as the noise in reference microphone signal ref and may therefore be subtracted by combiner 26A. Combiner 26A may also combine an attenuated high-frequency portion of near speech signal ns, i.e., sidetone information $st_h$, so that the user of wireless telephone 10 hears their own voice in proper relation to downlink speech ds. Near speech signal ns may also be provided to RF integrated circuit 22 and may be transmitted as uplink speech to a service provider via an antenna ANT. Similarly, left-channel audio integrated circuit 20A may generate an output for driving transducer SPKLL from an amplifier A2, which may amplify the output of a digital-to-analog converter (DAC) 23B that receives the output of a combiner 26B. Combiner 26B may combine source audio signal $ds_l$-$ia_{ll}$, which is the low-frequency band component of the output of combiner 26C with low-frequency band antinoise signal $antinoise_{ll}$ generated by ANC circuit 30, which by convention has the same polarity as the noise in reference microphone signal ref and may therefore be subtracted by combiner 26B. Combiner 26B may also combine an attenuated portion of near speech signal ns, i.e., sidetone low-frequency information $st_l$.

Figure 3:
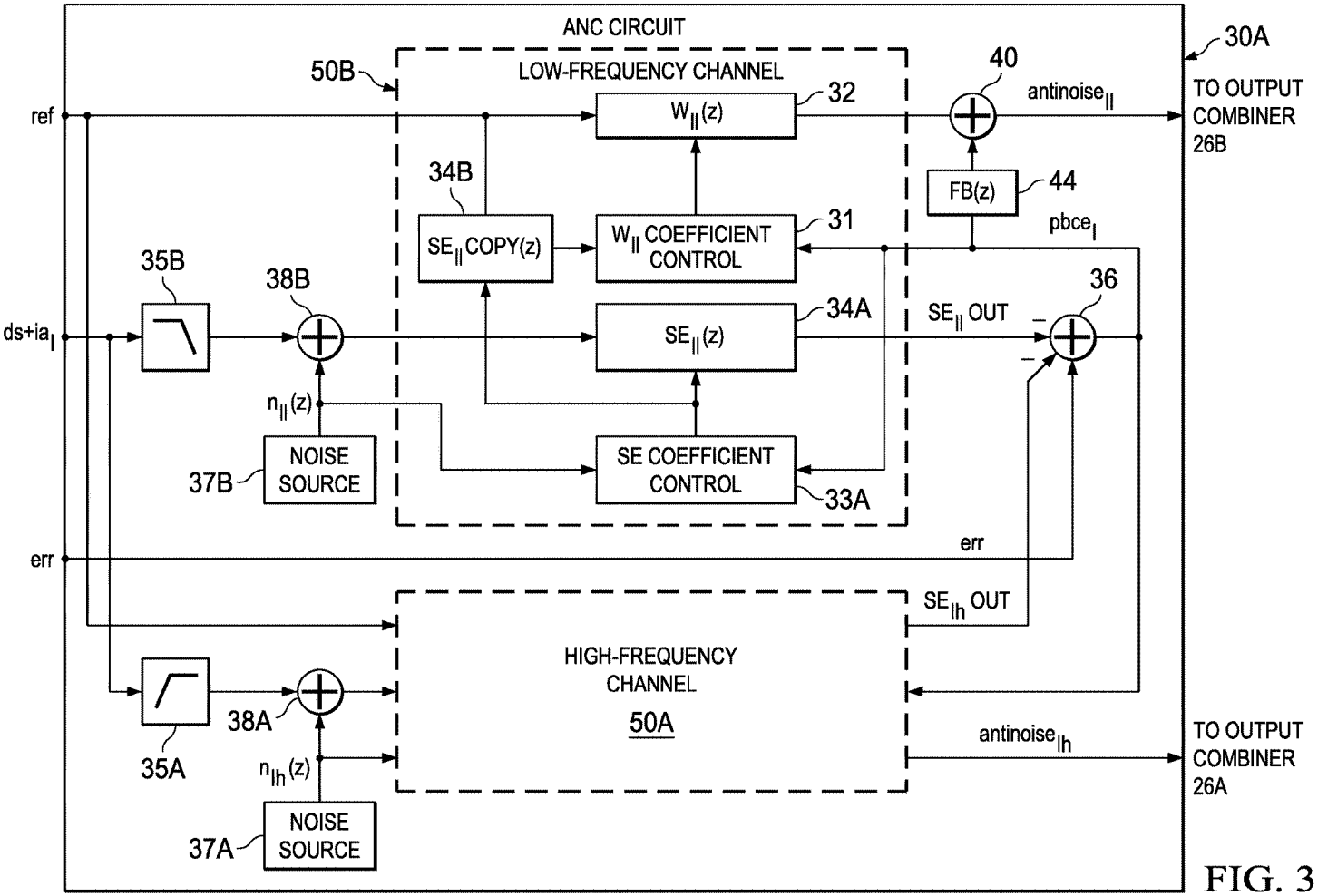
FIG. 3 is a block diagram of selected signal processing circuits and selected functional blocks of an ANC circuit, in accordance with embodiments of the present disclosure.

Referring now to FIG. 3, a block diagram of selected components of an ANC circuit 30A are shown, as may be used to implement at least a portion of audio integrated circuit 20A of FIG. 2. A substantially identical circuit may be used to implement audio integrated circuit 20B, with changes to the channel labels within the diagram as noted below. ANC circuit 30A may include high-frequency channel 50A and a low-frequency channel 50B, for generating antinoise signals $antinoise_{lh}$ and $antinoise_{ll}$, respectively. In the description below, where signal and response labels contained the letter "l" indicating the left channel, the letter would be replaced with "r" to indicate the right channel in another circuit according to FIG. 3 as implemented within audio integrated circuit 20B of FIG. 2. Where signals and responses are labeled with the letter "l" for low-frequency in low-frequency channel 50B, the corresponding elements in high-frequency channel 50A would be replaced with signals and responses labeled with the letter "r."

In ANC circuit 30A, an adaptive filter 32 may receive reference microphone signal ref and under ideal circumstances, may adapt its transfer function $W_{ll}(z)$ to be $P_l(z)/S_{ll}(z)$ to generate a feedforward component of antinoise signal $antinoise_{ll}$ (which may, as described below, be combined by combiner 40 with a feedback component of antinoise signal $antinoise_{ll}$ to generate antinoise signal $antinoise_{ll}$). The coefficients of adaptive filter 32 may be controlled by a W coefficient control block 31 that uses a correlation of two signals to determine the response of adaptive filter 32, which may generally minimize, in a least-mean squares sense, those components of reference microphone signal ref that are present in error microphone signal err. While the example disclosed herein may use an adaptive filter 32 implemented in a feed-forward configuration, the techniques disclosed herein may be implemented in a noise-cancelling system having fixed or programmable filters, where the coefficients of adaptive filter 32 may be pre-set, selected or otherwise not continuously adapted, and also alternatively or in combination with the fixed-filter topology, the techniques disclosed herein can be applied in feedback ANC systems or hybrid feedback/feed-forward ANC systems. Signals received as inputs to W coefficient control block 31 may include the reference microphone signal ref as shaped by a copy of an estimate of the response $S_{ll}(z)$ of the secondary path provided by a filter 34B and a playback corrected error signal $pbce_l$ generated by a combiner 36 from error microphone signal err. By transforming reference microphone signal ref with a copy of the estimate of the response $S_{ll}(z)$ of the secondary path, $SE_{ll}COPY(z)$, and minimizing the portion of the error signal that correlates with components of reference microphone signal ref, adaptive filter 32 may adapt to the desired response of $P_r(z)/S_{ll}(z)$.

In addition, source audio signal $ds+ia_l$ including downlink audio signal ds and internal audio signal $ia_l$ may be processed by a secondary path filter 34A having response $SE_{ll}(z)$, of which response $SE_{ll}COPY(z)$ is a copy. Low-pass filter 35B may filter source audio signal $ds+ia_l$ before it is received by low-frequency channel 50B, passing only the frequencies to be rendered by low-frequency transducer SPKLL (or SPKRL in the case of ANC circuit 30B). Similarly, high-pass filter 35A may filter the source audio signal ($ds+ia_l$) before it is received by high-frequency channel 50A, passing only frequencies to be rendered by the high-frequency transducer SPKLH (or SPKRH in the case of ANC circuit 30B). Thus, high-pass filter 35A and low-pass filter 35B form a crossover filter with respect to source audio signal $ds+ia_l$, so that only the appropriate frequencies may be passed to high-frequency channel 50A and low-frequency channel 50B, respectively, and having bandwidths appropriate to respective transducers SPKLH, SPKLL or SPKRH, SPKRL. By injecting an inverted amount of source audio signal $ds+ia_l$ that has been filtered by response $SE_{ll}(z)$, adaptive filter 32 may be prevented from adapting to the relatively large amount of source audio present in error microphone signal err. That is, by transforming the inverted copy of source audio signal $ds+ia_l$ with the estimate of the response of path $S_{ll}(z)$, the source audio that is removed from error microphone signal err before processing should match the expected version of source audio signal $ds+ia_l$ reproduced at error microphone signal err. The source audio amounts may approximately match because the electrical and acoustical path of $S_{ll}(z)$ is the path taken by source audio signal $ds+ia_l$ to arrive at error microphone E.

Filter 34B may not be an adaptive filter, per se, but may have an adjustable response that is tuned to match the response of secondary path adaptive filter 34A, so that the response of filter 34B tracks the adapting of secondary path adaptive filter 34A. To implement the above, secondary path adaptive filter 34A may have coefficients controlled by an SE coefficient control block 33A. For example, SE coefficient control block may correlate noise signal $n_{ll}(z)$ and a playback corrected error signal $pbce_l$ in order to reduce the playback corrected error signal $pbce_l$. Secondary path adaptive filter 34A may process the low or high-frequency source audio $ds+ia_l$ to provide a signal representing the expected source audio delivered to error microphone E. Secondary path adaptive filter 34A may thereby be adapted to generate a signal from source audio signal $ds+ia_l$, that when subtracted from error microphone signal err, forms playback corrected error signal $pbce_l$ including the content of error microphone signal err that is not due to source audio signal $ds+ia_l$. Combiner 36 may remove the filtered source audio signal $ds+ia_l$ from error microphone signal err to generate the above-described playback corrected error signal $pbce_l$.

As a result of the foregoing, each of high-frequency channel 50A and low-frequency channel 50B may operate independently to generate respective antinoise signals $antinoise_{lh}$ and $antinoise_{ll}$.

As depicted in FIG. 3, in some embodiments ANC circuit 30A may also comprise feedback filter 44. Feedback filter 44 may receive the playback corrected error signal $pbce_l$ and may apply a response $FB_l(z)$ to generate a feedback antinoise component of the antinoise signal $antinoise_{ll}$ based on the playback corrected error. The feedback antinoise component of the antinoise signal may be combined by combiner 40 with the low-frequency feedforward antinoise component of the antinoise signal generated by adaptive filter 32 to generate the low-frequency antinoise signal $antinoise_{ll}$ which in turn may be provided to combiner 26B that combines the low-frequency antinoise signal with the low-frequency source audio signal to be reproduced by an output transducer (e.g., SPKLL or SPKRL). Because content of an ANC feedback signal is typically in lower-frequencies in many ANC systems, the feedback antinoise component generated by feedback filter 44 may be combined by combiner 40 with the low-frequency antinoise component generated by adaptive filter 32 of low-frequency channel 50B rather than being combined with the high-frequency antinoise component generated by adaptive filter 32 of high-frequency channel 50A. Although FIG. 3 depicts presence of a feedback filter 44, in some embodiments, feedback filter 44 may not be present and no feedback antinoise component may be generated, in which case combiner 40 may also not be present and the low-frequency antinoise signal $antinoise_{ll}$ may be the low-frequency feedforward antinoise component of the antinoise signal generated by adaptive filter 32.

As shown in FIG. 3, a noise source 37A may inject a noise signal $n_{lh}(z)$ into the high-frequency component of the source audio signal $ds+ia_l$ generated by high-pass filter 35A, such that a combiner 38A combines the noise signal $n_{lh}(z)$ and the high-frequency component of the source audio signal $ds+ia_l$ into a combined signal that is processed by high-frequency channel 50A. Similarly, a noise source 37B may inject a noise signal $n_{ll}(z)$ into the low-frequency component of the source audio signal $ds+ia_l$ generated by low-pass filter 35B, such that a combiner 38B combines the noise signal $n_{ll}(z)$ and the low-frequency component of the source audio signal $ds+ia_l$ into a combined signal that is processed by low-frequency channel 50B. In order for the responses of the secondary path adaptive filters 34A of each of high-frequency channel 50A and low-frequency channel 50B to converge (e.g., for response $SE_{ll}(z)$ to converge to $S_{ll}(z)$ and response $SE_{lh}(z)$ to converge to $S_{lh}(z)$), the noise signal $n_{lh}(z)$ generated by noise source 37A may be substantially different (e.g., uncorrelated with, phase delayed with respect to) the noise signal $n_{ll}(z)$ generated by noise source 37B. These substantially different noise signals may comprise white noise signals which are shaped in the frequency domain to protect speaker drivers (e.g., amplifiers A1, A2, A3, A4) from certain frequency contents or to psychoacoustically mask the effect of the noise signals to a user's ears. For example, noise sources 37A and 37B may generate a noise signal in accordance with those techniques described in U.S. Pat. Pub. No. 20120308027 and U.S. Ser. No. 14/252,235 entitled "Frequency-Shaped Noise-Based Adaptation of Secondary Path Adaptive Response in Noise-Canceling Personal Audio Devices," which are incorporated herein by reference. As shown in FIG. 3, noise signals $n_{lh}(z)$ and $n_{ll}(z)$ may also be injected into each of high-frequency channel 50A and low-frequency channel 50B where such signals may be input to an SE coefficient control block (e.g., SE coefficient control block 33A) as described above.

In some embodiments, adaptation of feedforward adaptive filters 32 of high-frequency channel 50A and low-frequency channel 50B may be managed by adapting the feedforward adaptive filters 32 at different time intervals (e.g., feedforward adaptive filter 32 of high-frequency channel 50A adapts for an interval while adaptation of feedforward adaptive filter 32 of high-frequency channel 50B is halted, then in a successive interval, feedforward adaptive filter 32 of high-frequency channel 50B adapts for the successive interval while adaptation of feedforward adaptive filter 32 of high-frequency channel 50A is halted, and so on). In these and other embodiments, adaptation of feedforward adaptive filters 32 may be performed such that adaptation step sizes of the respective adaptive filters 32 are substantially different.

Although the discussion of FIG. 3 above contemplates that high-frequency channel 50A and low-frequency channel 50B of ANC circuit 30A each comprises respective adaptive filters 32, in some embodiments, ANC circuit 30A may comprise a single feedforward adaptive filter 32 which generates a single anti-noise signal from reference microphone signal ref. In such embodiments, such single anti-noise signal may be combined with the low-frequency source audio signal to generate the low-frequency output signal and separately combined with the high-frequency source audio signal to generate the high-frequency output signal. In such embodiments, ANC circuit 30A may also comprise a W coefficient control block 31 which may adapt the adaptive filter 32 based on a correlation between the playback corrected error signal (e.g., $pbce_l$) and a second signal, wherein the second signal is the combination of the reference microphone signal ref as filtered by a filter (e.g., filter 34B) applying a low-frequency secondary path estimate response (e.g., a response of $SE_l COPY(z)$ as applied by low-frequency channel 50B) and the reference microphone signal ref as filtered by a filter (e.g., filter 34B) applying a high-frequency secondary path estimate response (e.g., a response of $SE_h COPY(z)$ as applied by high-frequency channel 50A).

Although the discussion of FIG. 3 above contemplates that in some embodiments, high-frequency channel 50A is substantially identical to low-frequency channel 50B, in some embodiments, high-frequency channel 50A may not include components present in low-frequency channel 50B. For example, in some embodiments, low-frequency channel 50B may include adaptive filter 32 and W coefficient control block 31, while high-frequency channel 50A may not include corresponding components. In such an embodiment, high-frequency channel 50A may not generate a high-frequency antinoise signal, and thus, the high-frequency audio signal may simply pass to its associated transducer without added anti-noise. Thus, in such embodiments, high-frequency channel 50A may only include components necessary for adaptation of its secondary path estimate filter 34A.

As used herein, when two or more elements are referred to as "coupled" to one another, such term indicates that such two or more elements are in electronic communication whether connected indirectly or directly, with or without intervening elements.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

All examples and conditional language recited herein are intended for pedagogical objects to aid the reader in understanding the disclosure and the concepts contributed by the inventor to furthering the art, and are construed as being without limitation to such specifically recited examples and conditions. Although embodiments of the present disclosures have been described in detail, it should be understood that various changes, substitutions, and alterations could be made hereto without departing from the spirit and scope of the disclosure.

What is claimed is:

1. An integrated circuit for implementing at least a portion of a personal audio device, comprising:

a first output for providing a first output signal to a first transducer for reproducing a first frequency range content source audio signal comprising first frequency range content of a source audio signal, the first output signal including both the first frequency content source audio signal and an antinoise signal for countering the effects of ambient audio sounds in an acoustic output of an earspeaker comprising the first transducer and a second transducer;

a second output for providing a second output signal to the second transducer for reproducing a second frequency range content source audio signal comprising second frequency range content of the source audio signal, the second output signal including at least the second frequency range content source audio signal;

a reference microphone input for receiving a reference microphone signal indicative of the ambient audio sounds;

an error microphone input for receiving an error microphone signal indicative of the output of the earspeaker and the ambient audio sounds at the earspeaker; and a processing circuit comprising:

an adaptive filter having a response that generates the antinoise signal from the reference microphone signal to reduce the presence of the ambient audio sounds at the acoustic output, wherein the response of the adaptive filter is shaped in conformity with the reference microphone signal and the error microphone signal by adapting the response of the adaptive filter to minimize the ambient audio sounds in the error microphone signal;

a first signal injection portion which injects a first additional signal into the first frequency range content source audio signal; and a second signal injection portion which injects a second additional signal into the second frequency range content source audio signal, wherein the first additional signal and the second additional signal are substantially different.

2. The integrated circuit of claim 1, wherein the second output signal includes the second frequency range content source audio signal and the antinoise signal.

3. The integrated circuit of claim 1, wherein:

the second output signal includes the second frequency range content source audio signal and a second antinoise signal for countering the effects of ambient audio sounds in the acoustic output; and the processing circuit further comprises a second adaptive filter that generates the second antinoise signal from the reference microphone signal to reduce the presence of the ambient audio sounds at the acoustic output, wherein the response of the adaptive filter is shaped in conformity with the reference microphone signal and the error microphone signal by adapting the response of the adaptive filter to minimize the ambient audio sounds in the error microphone signal.

4. The integrated circuit of claim 3, wherein the adaptive filter and the second adaptive filter are adapted at different time intervals.

5. The integrated circuit of claim 3, wherein an adaptation step size of the adaptive filter is substantially different than an adaptation step size of the second adaptive filter.

6. The integrated circuit of claim 1, wherein the processing circuit comprises a feedback filter that generates a feedback antinoise component from the error microphone signal which is combined with a feedforward antinoise component generated by the adaptive filter to generate the antinoise signal.

7. The integrated circuit of claim 1, wherein the first additional signal and the second additional signal are noise signals.

8. The integrated circuit of claim 1, the processing circuit further comprising a crossover filter that generates the second frequency range content source audio signal and the first frequency range content source audio signal from the source audio signal.

9. The integrated circuit of claim 1, the processing circuit further comprising:

a first secondary path estimate filter configured to model an electro-acoustic path of the first frequency range content source audio signal and having a response that generates a first secondary path estimate from the first frequency range content source audio signal;

a first secondary coefficient control block that shapes the response of the first secondary path estimate filter in conformity with the first additional signal and the error microphone signal by adapting the response of the first secondary path estimate filter to minimize the error microphone signal;

a second secondary path estimate filter configured to model an electro-acoustic path of the second frequency range content source audio signal and having a response that generates a second secondary path estimate from the second frequency range content source audio signal; and a second secondary coefficient control block that shapes the response of the second secondary path estimate filter in conformity with the second additional signal and the error microphone signal by adapting the response of the second secondary path estimate filter to minimize the error microphone signal.

10. The integrated circuit of claim 1, wherein:

the first frequency range content of the source audio signal comprises lower-frequency range content of the source audio signal; and the second frequency range content of the source audio signal comprises higher-frequency range content of the source audio signal.

11. A method comprising:

generating a source audio signal for playback to a listener;

receiving a reference microphone signal indicative of ambient audio sounds;

receiving an error microphone signal indicative of an output of an earspeaker and the ambient audio sounds at the earspeaker, wherein the earspeaker comprises a first transducer for reproducing a first frequency range content source audio signal comprising first frequency range content of the source audio signal and a second transducer for reproducing a second frequency range content source audio signal comprising second frequency range content of the source audio signal;

adaptively generating an antinoise signal for countering the effects of ambient audio sounds at an acoustic output of the earspeaker by adapting a response of an adaptive filter that filters the reference microphone signal in conformity with the error microphone signal and the reference microphone signal to minimize the ambient audio sounds in the error microphone signal;

injecting a first additional signal into the first frequency range content source audio signal;

injecting a second additional signal into the second frequency range content source audio signal, wherein the first additional signal and the second additional signal are substantially different;

combining the antinoise signal with the first frequency range content source audio signal to generate a first output signal provided to the first transducer; and generating a second output signal provided to the second transducer, the second output signal including at least the second frequency range content source audio signal.

12. The method of claim 11, further comprising combining the antinoise signal with the second frequency range content source audio signal to generate the second output signal.

13. The method of claim 11, wherein:

adaptively generating a second antinoise signal for countering the effects of ambient audio sounds at the acoustic output by adapting a response of a second adaptive filter that filters the reference microphone signal in conformity with the error microphone signal and the reference microphone signal to minimize the ambient audio sounds in the error microphone signal; and combining the second antinoise signal with the second frequency range content source audio signal to generate the second output signal.

14. The method of claim 13, further comprising adapting the adaptive filter and the second adaptive filter at different time intervals.

15. The method of claim 13, wherein an adaptation step size of the adaptive filter is substantially different than an adaptation step size of the second adaptive filter.

16. The method of claim 11, further comprising:

generating a feedback antinoise component from the error microphone signal; and combining the feedback antinoise component with a feedforward antinoise component generated by the adaptive filter to generate the antinoise signal.

17. The method of claim 11, wherein the first additional signal and the second additional signal are noise signals.

18. The method of claim 11, further comprising generating the second frequency range content source audio signal and the first frequency range content source audio signal from the source audio signal with a crossover filter.

19. The method of claim 11, further comprising:

generating a first secondary path estimate from the first frequency range content source audio signal with a first secondary path estimate filter configured to model an electro-acoustic path of the first frequency range content source audio signal;

shaping a response of the first secondary path estimate filter in conformity with the first additional signal and the error microphone signal by adapting the response of the first secondary path estimate filter to minimize the error microphone signal;

generating a second secondary path estimate from the second frequency range content source audio signal with a second secondary path estimate filter configured to model an electro-acoustic path of the second frequency range content source audio signal; and shaping a response of the second secondary path estimate filter in conformity with the second additional signal and the error microphone signal by adapting the response of the second secondary path estimate filter to minimize the error microphone signal.

20. The method of claim 11, wherein:

the first frequency range content of the source audio signal comprises lower-frequency range content of the source audio signal; and the second frequency range content of the source audio signal comprises higher-frequency range content of the source audio signal.

* * * * *